US005433555A

United States Patent [19]

Parizot

[11] Patent Number: 5,433,555

[45] Date of Patent: Jul. 18, 1995

[54] WICKET DAM AND LIFTING JACK

[75] Inventor: Louis Parizot, Couzeix, France

[73] Assignee: Nancy Brac de la Perriere, Paris, France

[21] Appl. No.: 199,670

[22] Filed: Feb. 22, 1994

[51] Int. Cl.[6] ..... E02B 7/40

[52] U.S. Cl. ..... 405/100; 405/101; 405/108

[58] Field of Search ..... 405/87, 92, 90, 99, 405/100, 101, 107, 108

[56] References Cited

U.S. PATENT DOCUMENTS

| | | | |
|---|---|---|---|
| 419,287 | 1/1890 | Scaife . | |
| 983,937 | 2/1911 | Schildhauer | 405/99 |
| 2,335,327 | 11/1943 | Wellons . | |
| 3,718,002 | 7/1971 | Aubert . | |
| 3,775,983 | 12/1973 | Aubert . | |
| 4,073,147 | 2/1978 | Nomura | 405/101 X |
| 4,352,592 | 10/1982 | Aubert | 405/102 |
| 5,178,490 | 1/1993 | Snowberger et al. | 405/102 |
| 5,199,812 | 4/1993 | McClellan | 405/101 |
| 5,222,834 | 6/1993 | Schultz | 405/99 X |

FOREIGN PATENT DOCUMENTS

| | | | |
|---|---|---|---|
| 2570728 | 9/1984 | France . | |
| 720038 | 4/1942 | Germany | 405/100 |
| 282510 | 12/1986 | Japan | 405/100 |
| 202503 | 9/1991 | Japan | 405/101 |
| 161511 | 6/1992 | Japan | 405/92 |
| 317801 | 1/1957 | Switzerland | 405/100 |

OTHER PUBLICATIONS

Lecture given on Nov. 4, 1980 by Aubert entitled "New Process of Foundation in River Bed Application at Denouval Dam".

Article entitled "New River Bed Foundation Method Application to Denouval Barrage" by Aubert, 1982.

*Primary Examiner*—John A. Ricci

*Attorney, Agent, or Firm*—Rockey, Rifkin and Ryther

[57] ABSTRACT

The arrangement includes a downstream jack pivotably mounted about an axis in the floor of the dam and a rotating abutment member carried by the wicket for receiving an end of a jack piston rod. The jack is restored to an end angular orientation when the piston rod is moved away from the abutment member. This end angular orientation is determined by the axis joining the end upright position of the abutment member and the end down position of the abutment member. The piston rod of the jack and the abutment member are provided with a coupler for ensuring their engagement. The jack body is fitted with a sealing apparatus pivotably mounted about the same axis in the floor of the dam and out of which the jack body is easily removable.

10 Claims, 3 Drawing Sheets

80
85
14
11
8
90
92
35
9

WICKET DAM AND LIFTING JACK

BACKGROUND OF THE INVENTION

The present invention generally relates to hydraulic dams, and, more particularly, to a moveable gate system including a wicket and downstream jack for use with a hydraulic dam. The moveable gate is mounted between two abutments which are constructed along river banks at the ends of moveable dam's floor or on the spillway crest of a gravity dam.

The following patents are known gate systems which consist of juxtaposed elements of small size which can be displaced independently of each other: U.S. Pat. No. 419,287 to Scaife; U.S. Pat. No. 2,335,327 to Wellons; U.S. Pat. No. 3,718,002 to Aubert; U.S. Pat. No. 3,775,983 to Aubert; U.S. Pat. No. 4,352,592 to Aubert; U.S. Pat. No. 5,178,490 to Snowberger; and French Patent 2,570,728 to Aubert. The gate elements generally take a nearly vertical end position, a substantially horizontal end position and a number of intermediate positions therebetween.

The gate elements include a wicket panel which is pivotally mounted on the floor or body of a dam and are held in one of the aforesaid positions by means of a prop supported on stop catches as disclosed in the Aubert patents and Snowberger '490, or by means of pins as disclosed in Scaife '287 and Wellons '327. In Snowberger '490, the downstream end of the prop includes a weak point which fails in the event that a floating object impacts the wicket.

In Aubert '002, '983 and '592, the moveable gate element comprises a tie-frame or horse which is pivotably mounted to the floor or body of the dam and a wicket panel. The wicket panel is pivoted about a horizontal shaft or hinge-pin attached to the horse. During normal operations, the wicket panel and the horse remain in contact. In the event of impact, the additional degree of freedom introduced by the interposition of the horse between the wicket panel and the dam floor is advantageous in retaining integrity of the dam.

In the following description, the term "wicket" refers not only to the wicket panel but also to the other movable components which are associated therewith. For example, "wicket" applies both to the wicket panel, which is pivotally mounted to a hinged horse, or to other juxtaposed and differently arranged elements having small dimensions.

In the Scaife, Aubert and Snowberger patents, the moveable gate system is provided with an operating device which comprises an oscillating jack rotatably mounted with respect to a horizontal shaft which is attached to the floor or body of the dam. An abutment member is included which is orientable about the horizontal shaft attached to the wicket, the abutment member being adapted to receive the extremity of the jack rod during wicket operation.

In U.S. Pat. Nos. 3,775,983, 4,352,592 and 5,178,490, the jack rod is immersed in oil by withdrawing into the interior of the jack body between two operations of the dam. Thus, the jack rod is protected from any adverse effects of being exposed to water except during the operation of the wicket which are of relatively short duration. Over exposure of the jack rod to water can result in oxidation or in erosion if the water contains suspended substances.

Aubert '983 further includes a device for locking the main Jack body in position between two operations.

The locking device is controlled by supplying high pressure oil to the jack such that the locking action is suppressed automatically at the beginning of each operation by stopping the supply of oil. The system further comprises a device for locking the abutment member of the wicket dam between two operations.

Between two operations, the jack body on one hand and the abutment member of the wicket on the other hand accordingly retain the position which they assumed at the end of the previous operation. At the beginning of the next operation, the jack rod will be oriented towards the abutment member which will, in turn, be suitably positioned for receiving the jack rod.

In other known designs, various seals are provided to in the sill of the dam where the jack is partially housed and oscillating. This precludes the introduction of debris. Also, the removal of the sealing apparatus and the jack are facilitated by providing suitable seals. Examples of the above is French Patent No. 2,570,728 which discloses a sealing jacket in which the jack is partially encased and Snowberger '490 which discloses a slidable sealing means.

Snowberger includes an auxiliary alignment jack coupled to the lifting Jack for rotating the lifting jack between the corresponding position occupied by the wicket. A comparable design was also tested on a model stored at the Vives-Eaux dam on the Seine river near Paris.

In Aubert '592, the jack is associated with a restoring means which moves the jack to an angularly oriented end position, an extreme orientation, about its axis of pivotal motion when the jack operating rod is moved away from the abutment member. This end position is close to the positions assumed by the jack when the operating rod is in contact with the abutment member in the various inclined positions assumable by the wicket. The free end of the jack operating rod and the abutment member are provided with a guiding means. The guiding means ensures that the end of the jack operating rod is engaged with the abutment member when these components approach each other.

After each wicket operation, and as soon as the jack operating rod moves away from the abutment member and withdraws into the jack body, the restoring means places the jack in its extreme orientation. At the beginning of the following operation, the rod moves out of the jack body in the extreme orientation. When the end of the operating rod contacts the wicket's abutment member, the guiding means automatically brings the end of the operating rod into coincident relation with the abutment member.

The guiding means generally includes a cup fixed on the free end of the jack rod which is adapted to receive a spherical engaging member attached to the abutment member as taught by Aubert '592. In Snowberger '490, the guiding means comprises a separable cup bearing and a spherical wicket bearing mounted to a rear side of the wicket.

The prior art solutions to wicket dam construction involve a number of different problems. In Scaife '287, the jack is permanently connected either to the prop or to the wicket without posing an alignment problem. However, this arrangement is not convenient when the jack rod must be retracted within the jack body to protect it between two operations.

Aubert '002 also concerns a jack which is permanently connected to the wicket. Wellons '327 concerns a jack which is permanently aligned with the roller mounted on the wicket and is not amenable for use with oscillating cylinders.

Aubert '983 describes a sophisticated alignment means which is not sufficiently reliable. Aubert '592 describes a self alignment means in use on the Denouval dam which is difficult to employ in larger constructions. Snowberger '490 describes an alignment means which preferably uses an auxiliary Jack coupled to the lifting cylinder. This provides alignment to the single raised position of the wicket. Said model, tested at the Vives-Eaux dam and using an auxiliary jack system, did not provide a reliable locking of lifting cylinder.

French Patent No. 2,570,728 describes a sealing apparatus of the chamber provided in the sill in which the lower portion of the jack oscillates. The sealing apparatus includes a jacket which encases an upper portion of the jack and seals matching the contour of the jacket. Maintenance and repair of the jack and the sealing components is difficult due to the provision of the jacket and the seals.

It is desirable to provide an oscillating jack operated wicket dam which overcomes the aforementioned shortcomings of known designs and which provides improved chamber sealing in the sill of the dam to prevent the introduction of debris and silt.

SUMMARY OF THE INVENTION

The present invention provides a simple, economical and reliable process for self alignment of a downstream oscillating jack which operates a wicket. Additionally, the present invention is directed to an economical and reliable self aligning process, without any auxiliary mechanism, conveniently useable for any type of movable gate systems which include a wicket and a downstream oscillating jack where the piston rod of the jack is retracted within the jack body between two operations of the system.

The present invention is characterized in that, between two operations, the piston rod axis is substantially aligned with the lowered and raised portions of an abutment member which is secured to the wicket and adapted to receive the free end of the piston rod. The alignment is a single one and is convenient for raising a lowered wicket or for lowering a raised wicket, without the use of auxiliary means for alignment and locking.

The gate system contemplated by the invention utilizes at least one wicket which can be set at a number of predetermined angles of inclination about a shaft attached to the sill. Each wicket is provided with a jack pivotably mounted on the sill on the downstream side of the wicket. An abutment member is rotatably mounted on a shaft carried by the wicket, the abutment member being able to receive the free end of the piston rod of the jack.

Means are provided to ensure that the piston is retracted within the jack body between two operations. The free end of piston rod and the abutment member include a guiding means for ensuring positive engagement of the free end of the jack rod and the abutment when they come into contact. The guiding means comprises a spherical zone of the abutment member and a cup fixed on the free end of the piston rod. The jack is associated with a means for moving the jack to an alignment angle about its axis of rotation when the piston rod is moved away from the abutment member.

The alignment axis is a single one which is reached by self rotation of the jack about its horizontal axis of rotation until the axis of the piston rod of said jack and the alignment axis are identical. Also, the alignment axis is characterized in that the end down the end upright position of the abutment member constitute the alignment axis.

Such alignment process is simple, economical, reliable and applicable to constructions of any size. There is no need of auxiliary means for rotating the jack to the alignment angle or for providing a second alignment angle, which is the case in the aforementioned designs.

The present invention is also directed to a sealing system for the chamber provided in the sill, consistent with the arrangements necessary for the alignment process of the jack and providing facilities for easy removal of said jack and maintenance. The sealing system mainly includes a jacket encasing the upper portion of the jack, pivotably mounted together with the jack, and seals matching the contour of the jacket.

Further distinctive features and advantages of the invention will be more apparent when considering the following description and subsequent drawings where a number of embodiments are described and illustrated without any limiting cause.

DETAILED DESCRIPTION OF A PREFERRED EMBODIMENT

Figure 1:
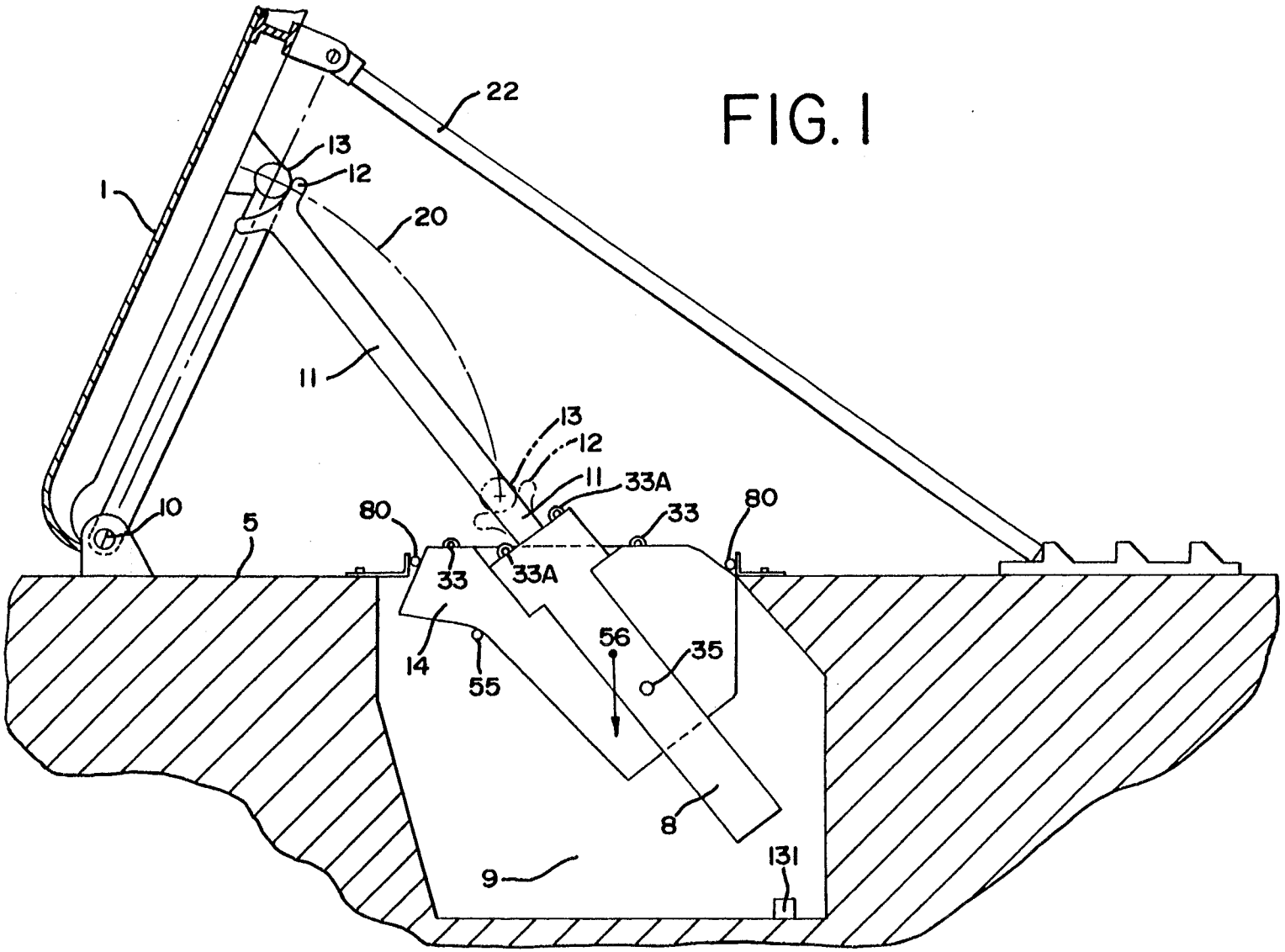
FIG. 1 is a side sectional view of the wicket in raised position supported on the prop.

FIG. 1 illustrates an arrangement according to the invention. The wicket 1 is rotatably mounted about the axis 10 secured to the sill 5. In the raised position, the wicket 1 is supported by the prop 22 and the piston rod 11 is retracted within the body of cylinder 8 which is encased in the jacket 14. Jacket 14 can rotate about the trunnions 35 inside the wet chamber 9 which is sealed from debris and silt by means of the sealing 80 matching the contour of jacket 14. The wet chamber 9 is periodically drained by opening drain 131. The jacket 14 rests on the stop bearing 55 located within the wet chamber 9. The piston rod 11 is aligned in FIG. 1.

A distinctive feature of the present invention is that the center of gravity 56 of the module including the cylinder 8 and the jacket 14 is located on the upstream side of the trunnions 35 when the piston rod 11 is retracted as shown in FIG. 1. In the raised position, the ball 13 which is secured to the wicket 1 is no more engaged with the cup 12 which is mounted on top of piston rod 11 and retracted as shown on FIG. 1.

Figures 3, 4A, 4B, 4C:
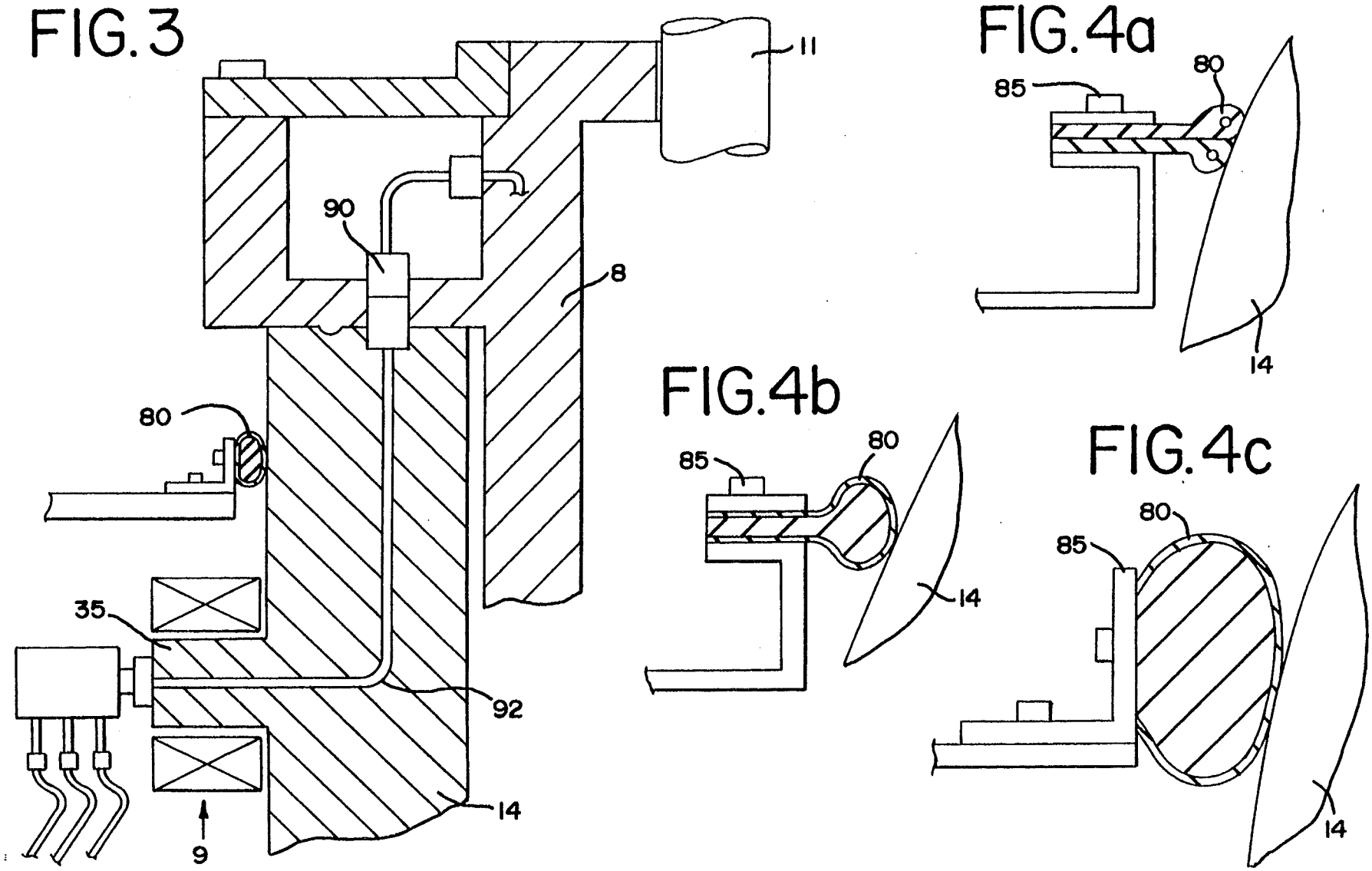
FIG. 3 is a sectional view showing the oil ducts.
FIGS. 4A–4C are a sectional view showing typical sealings.

The cylinder 8 is fitted with eyelets 33A and quick couplers 90 as illustrated in FIG. 3, for easy removal. The jacket 14 is also fitted with eyelets 33 in case any removal is necessary. The sealings 80 are mounted on a structure 85 bolted to the sill and easily removable when necessary as illustrated in FIGS. 4A–4C which show three embodiments of the sealing 80 and structure 85. The oil ducts 92 are integrated within the trunnions 35 and the jacket 14 as shown in FIG. 3.

Figure 2:
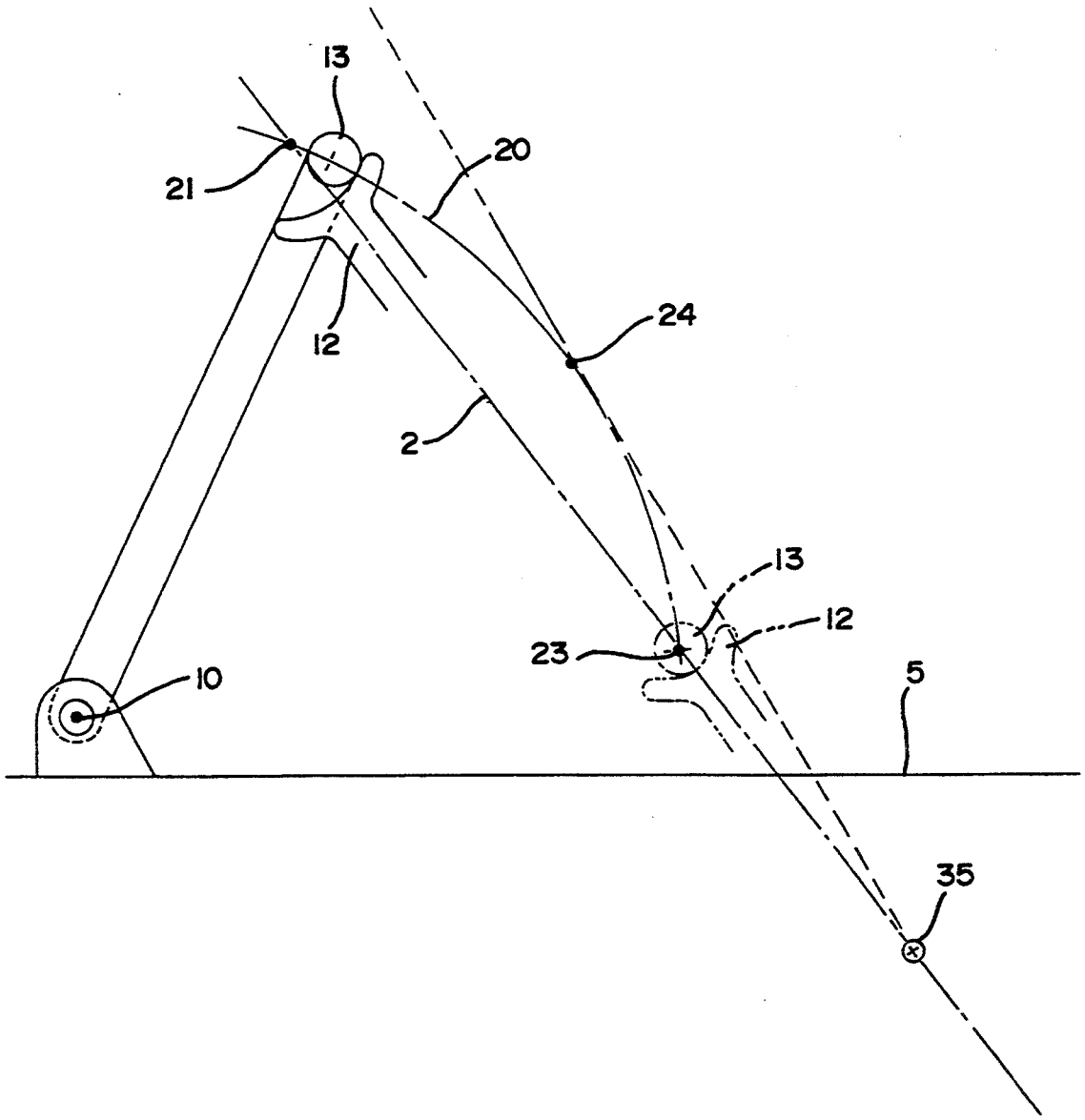
FIG. 2 is a schematic drawing showing the various positions of ball and cup during operation of the wicket.

FIG. 2 shows the various positions of the ball 13 along the circle 20 whose center is the axis 10, among which the extreme upright position 21 which corresponds to the maximum stroke of the piston rod 11 said arrangement constituting a distinctive feature. Such position 21 is reached when the prop 22 has to be disengaged from the hurter, before the wicket 1 can be lowered. The alignment axis 2 joins the position 21 and the axis of trunnions 35.

According to FIG. 1, when the module is supported on the stop bearing 55, the cylinder axis and the alignment axis 2 are the same, while the ball 13 is very close to the position 21 so that the cup 12 can easily engage the ball 13. The position of the alignment axis 2 is stable since the jacket 14 is supported on the stop bearing 55 whatever is the position of the cup 12.

FIG. 2 shows the down position 23 of the ball 13 corresponding to a wicket 1 fully lowered and resting on sill 5. The cup 12 is retracted and disengaged from the ball 13 by means of further retraction of piston rod 11, as shown in FIG. 2. A distinctive feature is that the positions 21 and 23 of the ball are always aligned with the axis of horizontal trunnions 35 and are also aligned with the axis of the piston rod 11 when the jacket 14 rests on the top bearing 55. This arrangement secures a single alignment angle.

The extreme side position 24 of the ball 13 is reached during the rotation of the ball 13 along the circle 20, only when ball 13 and cup 12 are engaged either on up or down trip and are pressed by the weight of the wicket 1 and the water head if any, so that they cannot disengage while the jacket 14 together with the cylinder 8 rotate above the trunnions 35. When disengaged from the ball 13, the cup 12 moves along the alignment axis 2 according to FIG. 2.

A distinctive feature is that the position of the center of gravity 56 secures a sufficient force to cause the jacket 14 to rotate till its resting position on stop bearing 55, as soon as the pressure between cup and ball disappears, which happens when the wicket 1 is supported either on prop 22 or on sill 5. This arrangement secures a simple self rotation of the cylinder 8 until the axis of piston rod 11 reaches the alignment axis 2.

From FIG. 2, it is clearly apparent that the force exerted by the piston rod 11 on the ball 13 when the wicket 1 is lowered is sufficient to raise the wicket and more important than in the prior arrangement of U.S. Pat. No. 4,352,592.

It will be readily apparent to those skilled in the art that various changes may be made and that the invention is not limited to present preferred arrangements without departing from the scope and spirit of the invention. For example, the sealing means may not be the jacket 14, but a slidable cover; the wicket may include or not an horse as mentioned in the background; the jack may be activated by a pump integrated in the jack body; the stop bearing 55 may be located in another place than illustrated in FIG. 1, and may be removable and adjustable; the number of raised positions of ball 13 when the wicket is supported by the prop 22 may be increased to more than one in case of small constructions; the trunnions 35 may be integrated in the cylinder 8 or in the jacket 14 or in any other sealing apparatus which is capable to transmit the thrust; the axis of trunnions 35 may not be along the alignment axis 2.

While the invention has been illustrated and described in detail in the drawings and the foregoing description, the same is to be considered as illustrative and not restrictive in character, it being understood that only the preferred embodiment has been shown and described and that all changes and modifications that come within the spirit of the invention are desired to be protected.

What is claimed is:

1. A gate system for a hydraulic dam having a dam floor and including at least one operating device which operates a wicket having a support prop, said wicket capable of assuming a number of predetermined angles of inclination about a horizontal shaft which is attached to the dam, the operating device comprising:

(a) a jack pivotally mounted to the dam downstream from the wicket, said jack having a jack body and an operating rod extending therefrom which terminates in a free end;

(b) an abutment member rotatably mounted on a horizontal shaft carried by the wicket, said abutment member being intended to receive the free end of the operating rod of the jack;

(c) said wicket being adapted for movement to a plurality of predetermined inclinations between an end upright position, and an end down position in which the wicket rests against the dam floor and means for ensuring that the operating rod of the jack is fully withdrawn into the jack body when said wicket assumes one of said predetermined inclinations;

(d) restoring means for moving the jack to an end angular orientation about its axis of pivotal motion, said end angular orientation being determined by the axis joining the end upright position of the abutment member and the end down position of the abutment member; and (e) coupling means formed by said free end of the operating rod of the jack and by the abutment member, said coupling means comprising a cup-like member and a convex member, one of which is carried by the abutment member and the other by the free end of the jack, the cup-like member being large enough to contact and receive therein the convex member in any of the predetermined inclinations of the wicket when said wicket is supported on its prop or resting on the floor of the dam.

2. A gate system according to claim 1, wherein the convex member is carried by the wicket and comprises a spherical zone traversed by said horizontal shaft, while the cup-shaped member is fixed on the free end of the operating rod, wherein the dimensions of the cup are such that, in each of the aforesaid predetermined positions of the wicket, the center of the spherical zone of the abutment member is located within the interior of the cylinder swept by the cup when the jack is disposed in the aforesaid end angular orientation.

3. A gate system according to claim 1, wherein the restoring means permits the center of gravity of the jack to remain located on the upstream side with respect to the axis of pivotal motion of said jack irrespective of the position of the operating rod of said jack.

4. A gate system according to claim 1, in which said jack body is partially placed within a housing in the floor of the dam and wherein the restoring means maintains the housing applied against a bearing in the end angular orientation of said jack.

5. A gate system according to claim 1, further comprising a housing formed in the floor of the dam, said housing being sealed from debris by a sealing apparatus which is secured to and is pivotable with the upper portion of the jack body, said sealing apparatus forming with the jack a module having its center of gravity on the upstream side with respect to its axis of pivotal motion irrespective of the position of the operating rod of said jack.

6. A gate system according to claim 5, wherein the module is applied against a bearing in the end angular orientation of the jack.

7. A gate system according to claim 6, wherein the axis of pivotal motion of the module is integrated in the sealing apparatus.

8. A gate system according to claim 5, wherein the sealing apparatus includes a jacket in which the jack body is partially encased and out of which said Jack body is easily removable.

9. A gate system according to claim 8, wherein the jacket is applied against a bearing in the end angular orientation of the jack.

10. A gate system according to claim 1, wherein the end upright position of the abutment member corresponds to the maximum stroke of the piston rod of the jack.

* * * * *